US006265859B1

(12) United States Patent
Datar et al.

(10) Patent No.: US 6,265,859 B1
(45) Date of Patent: Jul. 24, 2001

(54) CURRENT MIRRORING CIRCUITRY AND METHOD

(75) Inventors: Rajendra Datar; Manoj Soman, both of Pune (IN)

(73) Assignee: Cirrus Logic, Inc.

( * ) Notice: Subject to any disclaimer, the term of this patent is extended or adjusted under 35 U.S.C. 154(b) by 0 days.

(21) Appl. No.: 09/659,162

(22) Filed: Sep. 11, 2000

(51) Int. Cl.[7] ..... G05F 3/16; G05F 3/20
(52) U.S. Cl. ..... 323/315; 323/312
(58) Field of Search ..... 323/315, 313, 323/312, 314

(56) References Cited

U.S. PATENT DOCUMENTS 5,625,281 * 4/1997 Lambert ..... 323/315
5,684,394 * 11/1997 Marshall ..... 323/315
5,877,616 * 3/1999 Wan et al. ..... 323/315
5,936,392 * 8/1999 Taylor ..... 323/315
6,188,211 * 2/2001 Ricon-Mora et al. ..... 323/280

* cited by examiner

*Primary Examiner*—Peter S. Wong
*Assistant Examiner*—Bao Q. Vu
(74) *Attorney, Agent, or Firm*—James J. Murphy, Exq.; Winstead Sechrest & Minick

(57) ABSTRACT

A current mirror 100 includes a current mirroring transistor 103 having a selected aspect ratio for conducting a mirrored current of a selected mirroring ratio with respect to a reference current. A plurality of reference current transistors 201 are disposed in parallel with current mirroring transistor 103, each of the reference current transistors 201 having a current path coupled to a source 105 of the reference current and a selected aspect ratio. A switch 207 is coupled to a control terminal of a selected reference current transistor 201*a*, for selectively turning on and turning off a selected reference current transistor 201*a* to adjust the mirroring ratio.

22 Claims, 2 Drawing Sheets

100

Vdd
W/L=m
W/L=4m
W/L=6m
211
102
103
104
MIRRORED CURRENTS COMPENSATION
I
4I
6I
Vb1
101a
101b
REFERENCE CURRENT MEASUREMENT
ANALOG CIRCUITRY
ANALOG CIRCUITRY
200
IREF=1
105

200

Vdd
102
W/L= 0.25m
W/L= 0.25m
W/L= 0.25m
W/L= 0.25m
W/L= 0.25m
201a
201b
201c
201d
201e
S3
S4
207
208
211
204
EXTERNAL TEST SYSTEM 209
206
S1
S2
203
202
200
IREF
105

CURRENT MIRRORING CIRCUITRY AND METHOD

BACKGROUND OF THE INVENTION

1. Field of the Invention

The present invention relates in general to electronic circuitry and in particular, to current mirroring circuitry and methods.

2. Description of the Related Art

Current mirrors have many applications, including those in analog circuits such as operational amplifiers, comparators, band gap references, and the like. In one common current mirroring technique, a reference current is generated and then replicated (mirrored) through parallel weighted current paths using a set of matched transistors of appropriate aspect ratios. The resulting set of graduated currents can then, for example, be used to bias or drive other circuits in the device in varying ratios.

One of the drawbacks of using parallel transistors in current mirrors is their sensitivity to such factors as power supply variation, operating temperature variation, and fabrication process tolerances. Temperature and power supply variation can cause the currents to drift from their nominal design values, unless suitable compensation is provided for making the current paths track with the temperature and power supply changes. Fabrication process variations can cause the conductance of the transistors, and hence the accuracy in the current mirroring, to vary from wafer to wafer or even between circuits on the same wafer. For example, even if the channel width to length ratios of the transistors are held well within design tolerances, other factors such as differences in oxide thickness, carrier mobility and carrier doping levels can still cause variation in transistor conductivity.

Given the usefulness of current mirrors in a wide range of electronic circuit applications, better techniques are needed for compensating for temperature, process, and/or power supply variation in circuits employing current mirrors.

SUMMARY OF THE INVENTION

According to the principles of the present invention, a current mirror is disclosed which includes a current mirroring transistor having a selected aspect ratio for conducting a mirrored current of a selected mirroring ratio with respects to a reference current. A plurality of reference current transistors are disposed in parallel with the current mirroring transistor, each of the reference current transistors having a current path coupled to a source of the reference current and a selected aspect ratio. A switch is coupled to a control terminal of a selected one of the reference current transistors for selectively turning on and turning off the selected reference current transistor to adjust the mirroring ratio.

The inventive concepts provide an efficient mechanism for compensating for fabrication process, variation in current sourcing devices. Among other things, these concepts can be used to tune the mirroring ratios in a current mirror such that a precise current mirroring is possible. Additionally, these concepts can be implemented using a minimum amount of additional hardware and can be applied on a device by device basis.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The principles of the present invention and their advantages are best understood by referring to the illustrated embodiment depicted in FIGS. 1–4 of the drawings, in which like numbers designate like parts.

Figure 1:
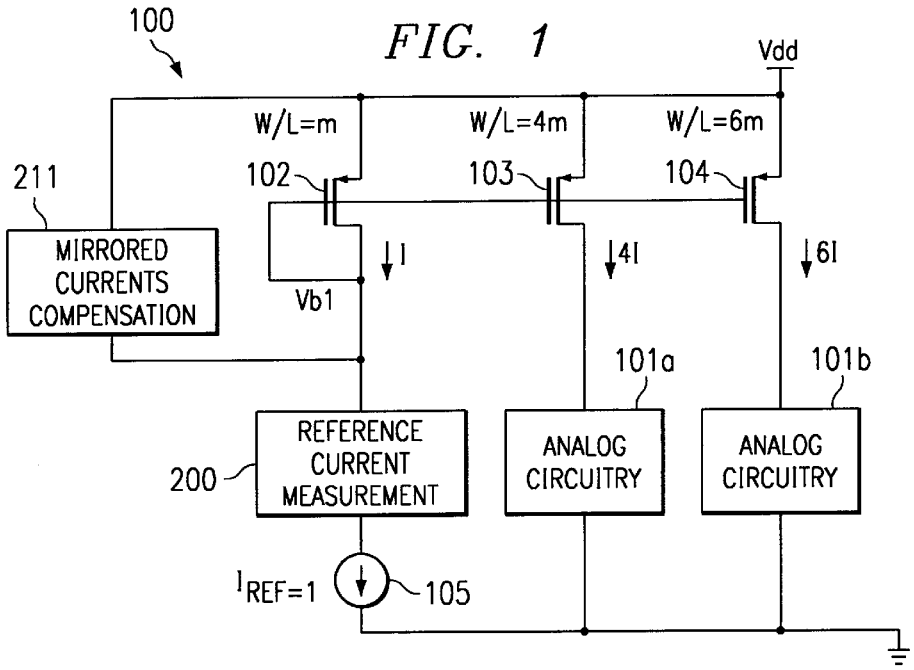
FIG. 1 is a diagram of exemplary circuitry embodying current mirroring techniques according to the inventive concepts.
Figure 2:
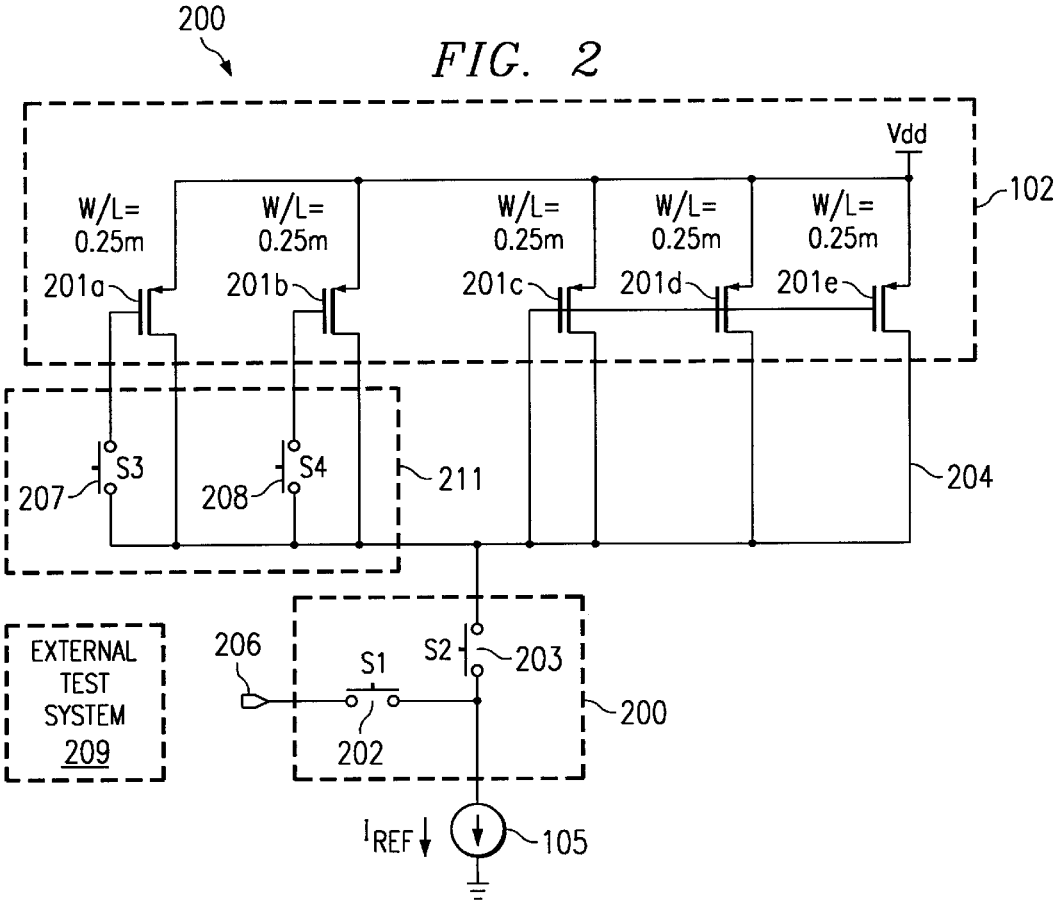
FIG. 2 shows in detail the reference current compensation circuitry.

FIG. 1 is a diagram of exemplary circuitry 100 embodying current mirroring techniques according to the inventive concepts. Circuitry 100 includes a pair of analog circuit blocks 110*a* and 101*b* which could include, for example, operational amplifiers, comparators, analog to digital converters, digital to analog converters, or similar circuitry requiring graduated or differing current levels. It should be noted that blocks 101 could also comprise digital circuitry, or mixed analog-digital circuitry.

The illustrated current mirror comprises three matched p-channel transistors 102–104 and a reference current source 105. Here, circuitry 100 operates from a high voltage rail at a voltage Vdd and a low voltage rail at ground. The gate source voltages of transistors 102–104 are set at voltage Vdd–Vb1, where Vb1 is the chosen bias voltage. It should be recognized that in alternate embodiments, transistors 102–104 may be n-channel field effect transistors or bipolar devices.

For purposes of illustration, it will be assumed that the designed reference current $I_{REF}$, as well as the current through transistor 102, has a value I (i.e. $I_{REF}$=I). Additionally, it will be assumed that the mirrored currents through transistors 103 and 104 have been respectively chosen to be 4I and 6I. (These values have been chosen for convenience and clarity in the present discussion, and may vary between actual applications). In the illustrated circuit, the channel width to length (aspect) ratios of transistors 102–104 are correspondingly m, 4 m, and 6 m. Thus, when the reference current $I_{REF}$ is made to flow through transistor 102, the currents flowing through transistors 103 and 104 are correspondingly proportional as a function of their W/L ratios with respect to the W/L ratio of transistor 102, since the gate- source voltages of all three transistors are identical.

According to the inventive principles, the mirroring ratios, and therefore the mirrored currents, are tuned for each current mirror on the wafer during wafer test. This capability is supported by reference current measurement circuitry 200 and mirrored currents compensation circuitry 211, shown in detail in FIG. 2. In the embodiment shown in FIG. 2, transistor 102 is constructed from a set of parallel p-channel transistors 201*a*–201*e* which have length to width ratios which sum to some multiple of m given above in FIG. 1. In this case, five transistors, each with a width to length ratio of 0.25 m, will be considered for discussion purposes. As discussed further below, the W/L ratio of transistor 102 is directly proportional to the combined W/L ratios of those transistors 201 which are turned-on and conducting in the operating mode.

Reference current measurement circuitry 200 comprises a first set of switches 202–203, respectively labeled S1–S2, for disabling node 204, at the sources of transistors 201*a*–201*e* and gates of transistors 201*c*–201*d*, from reference current source 105 and coupling the reference current source 105 to a test pint 206. As will be discussed further, switches S1–S2 enable measurement of the reference current $I_{REF}$ by an external tester 209 during a test mode.

A second set of switches, 207 and 208, respectively labeled S3 and S4, are provided for selectively coupling the gates of transistors 201*a* and 201*b* with Node 204, and generally allow for adjustment of the mirrored ratios and tuning of the mirrored current.

With switch S4 turned-on and switch S3 turned-off, the overall circuit configuration is the same as shown in FIG. 1 (i.e., the aspect ratios between transistors 102–104 are at their nominal values in m:4 m:6 m). On the other hand, when both switches S3 and S4 are turned-off, the W/L ratio of transistor 102 is only 0.75 m which results in the new mirroring ratios of 0.75 m:4 m: 6 m. The resulting currents through transistors 102–104 are now respectively I, 4/0.75 I and 6/0.75 I. Alternatively, with both switches S3 and S4 turned-on, the W/L ratio of transistor 102 becomes 1.25 m. In this case, the mirrored ratios for transistors 102–104 are 1.25 m:4 m 6 m leading to the corresponding mirrored currents of I:4/1.25 I:6/1.25 I. Hence, nearly a 25% increase or decrease in the desired mirror current is achieved for the case where transistors 201 each have a 0.25 m W/L ratio and two transistors 201*a,b* can be programmed to an on or off state.

During the test mode, switches S1 and S4 are turned-on and conducting. At the same time, switches S2 and S3 are turned-off. In this configuration, the current ratios are I:4I:6:I through transistors 102–104 respectively. External tester 209 is then used to measured the reference current $I_{REF}$. The deviation of the reference current measured from the designed (expected) reference current can then be determined.

If the actual current flow deviates from the designed current flow, switches S3 and S4 then used to make the appropriate adjustment. For example, if the measured reference current is too high with respects to the designed value, then the current mirroring ratios must be lowered. In this case, switch S3 is turned-on (closed) such that transistor 201*a* conducts current. The total W/L ratio for transistor 102 is now 1.25 m and the mirroring ratios between transistors 102–104 are I:4/1.25 m:6/1.25 m. On the other hand, if the measured current is too low, the current mirroring ratios must be increased. In this case, switch S4 is also turned-off (opened), so that neither transistors 201*a* nor 201*b* is conducting. The total W/L ratio for transistor 102 in this case is 0.75 m and the resulting mirroring ratios are I:4/0.75 m:6/0.75 m, for transistors 102–104, respectively. Once the proper current has been established, corresponding bits are set, as discussed below, in register to fix switches S3 and S4 in the selected configuration.

It should be noted that while two switches (S3 and S4) and two associated transistors (201*a,b*) are provided for current adjustment in the illustrated embodiment, more switches and/or transistors can be provided to increase the available adjustment resolution. Additionally, the aspect ratios of transistors 201 can also be changed, as required, to change the resolution. For example, the addition of each switch/transistor combination in parallel with the existing transistors 201, an additional adjustment step of 0.25I in the current mirroring ratio is available (assuming that the aspect ratios of each additional transistor 201 is 0.25 m)

To transition to the normal operating mode, switch S1 is opened (turned-off) and switch S2 is closed (turned-on). Non-volatile register bits can be set to maintain switches S1–S2 in the normal operating configuration after the reference current mirror ratio adjustments are complete.

Figure 3:
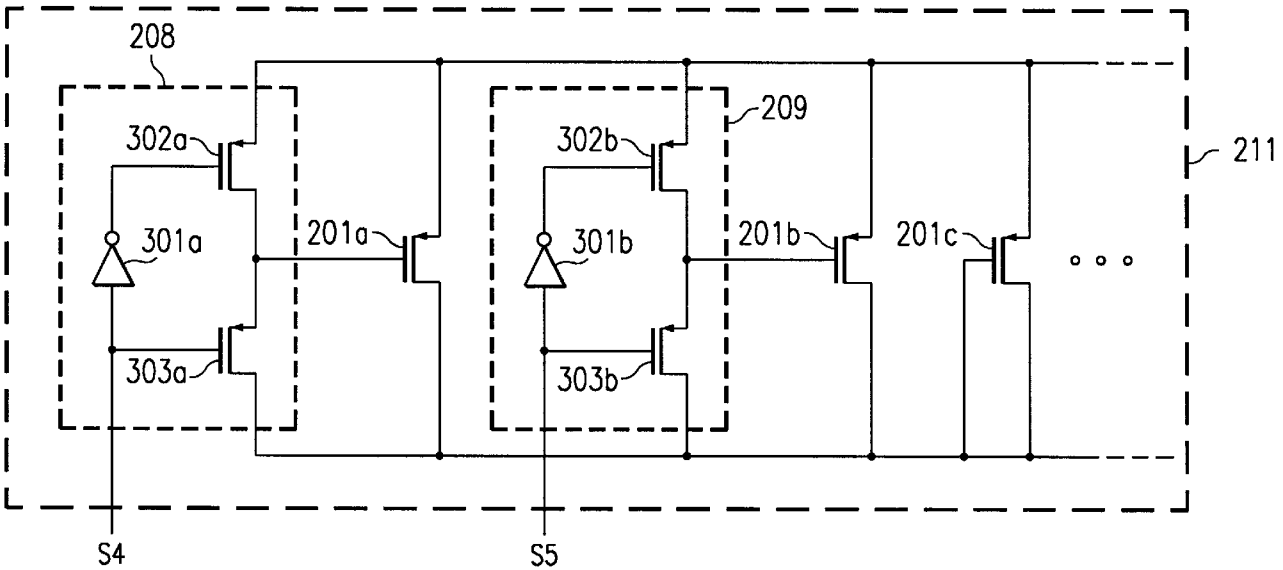
FIG. 3 illustrates a preferred means of implementing switches.

FIG. 3 illustrates a preferred means of implementing switches S3 and S4. In this case, each switch 208/209 includes an inverter 301 and a pair of p-channel transistors 302 and 303 coupled in a push-pull configuration with their common source/drain node controlling the gate of the corresponding transistor 201*a* or 201*b*. For example, consider the case of switch 208 (S3) and transistor 201*a*. When the control signal S3 is in a logic high state, the associated pull-up transistor 302*a* is on and pulls-up the gate of transistor 201*a* to the high voltage rail, thus turning transistor 201*a* off. Pull-down transistor 303*a* is off. On the other hand, when S3 is in a logic low state, pull-up transistor 302*a* is off and pull down transistor 303*a* is on, pulling-down the gate of transistor 201 to the low-voltage rail and turning transistor 201*a* on. Switch S4 works in a similar fashion in controlling the gate of transistor 201*b*.

Figure 4:
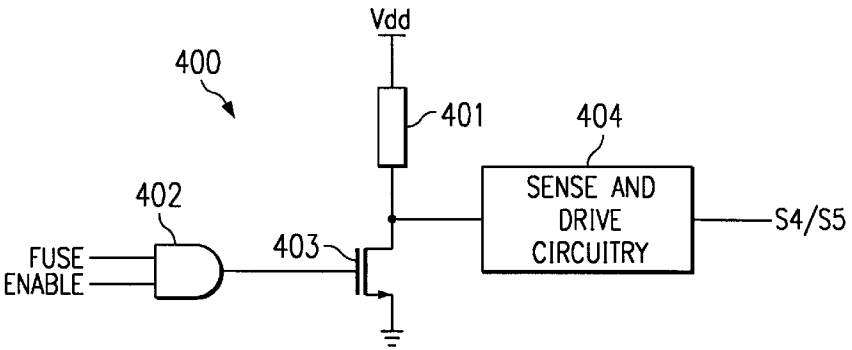
FIG. 4 depicts an exemplary non-volatile programmable element based on a polyfuse which is suitable for programming the final states of switches S3–S4.

FIG. 4 depicts an exemplary non-volatile programmable element 400 based on a polyfuse 401 which is suitable for programming the final states of switches S3–S4. Advantageously, programmable element 400 can be used in devices which do not include EPROM or EEPROM.

Programming element 400 proceeds as follows. Initially, the control signals +FUSE and ENABLE, presented at the inputs of AND gate 402, are in a logic low state. Consequently, transistor 403 is initially turned-off. Sense and drive circuitry 404 operates such that the switches S3–S4 are in their default state described above (i.e. S2 and S3 are off for test and switches S1 and S4 on for test).

Assume that measured reference current is lower than the expected (design) reference current. In this case, additional current mirror ratio is required by opening (turning-off) switch 54. The ENABLE signal for the element 400 controlling switch S4 transitions to a logic high state. Similarly, the corresponding signal FUSE transitions to a logic high state such that the associated transistor 403 turn-on and the resulting current conduction blows fuse 401. Sense and drive circuitry 404 senses the change in state of fuse 401 and turns-off switch S4.

Switch S2 can be closed in the normal mode and switch S3 opened in a similar fashion. It should be noted that switch S2 can be driven by an invertor controlled by the state of the programmable element controlling switch S1.

The switching structure of S1 and S2 is such that it also can be used to characterize the analog circuitry 101*a*–101*b* for various bias current values to find their optimum performance. This feature is especially beneficial when the fabrication process 'mean' shifts. By keeping S1 and S2 both 'closed,' the external test system 209 is made to source or sink additional current text through test pin 206. Performance measurement of analog circuitry 101*a*–101*b* is now made and appropriate switch settings S3–S4 of 211 identified.

In sum, the inventive concepts allow for the current mirroring ratios in a current mirror circuit to be set with varying degrees of accuracy. Depending on the number of switches and transistors used, as discussed above, the precision of the fabrication technology, and the given application. These principles are not limited to the current mirror example described above. One particular application in which the inventive concepts can advantageously be applied is in analog to digital (A/D) and digital to analog (D/A) converters. Here, a selected I/O pin is used to observe the signal or conversion gain, which can then be corrected by switching in or out additional output transistors.

Although the invention has been described with reference to a specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore, contemplated that the claims will cover any such modifications or embodiments that fall within the true scope of the invention.

What is claimed:

1. A current mirror comprising:

a current mirroring transistor having a selected aspect ratio for conducting a mirrored current of a selected mirroring ratio with respects to a reference current;

a plurality of reference current transistors disposed in parallel with said current mirroring transistor, each of said reference current transistors having a current path coupled to a source of said reference current and a selected aspect ratio; and a switch coupled to a control terminal of a selected one of said reference current transistors for selectively turning-on and turning-off said selected reference current transistor to adjust said mirroring ratio.

2. The current mirror of claim 1 and further comprising test switching circuitry for measuring said reference current in a test mode.

3. The current mirror of claim 1 wherein an initial state of said switch is closed and said switch is opened to increase said mirrored current ratio.

4. The current mirror of claim 1 wherein an initial state of said switch is open and said switch is closed to decrease said mirrored current ratio.

5. The current mirror of claim 1 wherein said aspect ratio of said plurality of transistors is substantially equal.

6. The current mirror of claim 2 wherein said test switching circuitry comprises a first switch for selectively decoupling said current paths of said reference transistors from said source of said reference current and a second switch for connecting said source of said reference current with a test system.

7. A current mirror comprising:

a first plurality of parallel transistors each having an aspect ratio selected for conducting a corresponding amount of current mirrored from a reference current in a selected mirroring ratio;

a second plurality of transistors for setting the mirroring ratio, a switch selectively coupling a current path of each of said second plurality of transistors to a current source in an operating mode and decoupling said current paths from said current source in a test mode; and compensation circuitry for varying a combined aspect ratio of said second plurality of transistors comprising:

a plurality of switches each controlling a voltage at control terminal of a corresponding one of said second plurality of transistors;

a switch for coupling an external test device and said current source in said test mode to measure said reference current; and a plurality of programmable elements for setting a state of each of said plurality of switches.

8. The current mirror of claim 7 wherein said first and second pluralities of transistors comprise field effect transistors.

9. The current mirror of claim 8 wherein said field effect transistors comprise p-channel field effect transistors.

10. The current mirror of claim 7 wherein said plurality of programmable elements comprise a plurality of fuses.

11. The current mirror of claim 7 wherein said plurality of switches each comprise a pair of transistors coupled in a push-pull configuration.

12. The current mirror of claim 7 wherein the aspect ratio of said second plurality of transistors is substantially equal.

13. The current mirror of claim 7 wherein each of said plurality of switches comprises:

a first transistor for pulling down the control terminal of the corresponding one of said second plurality of transistors to a low voltage in response to a control signal; and a second transistor for pulling up the control terminal of the corresponding one of said second plurality of transistors to a high voltage in response to a complement of said control signal.

14. An integrated circuit comprising:

processing circuitry operating in response to a plurality of currents comprising:

a first plurality of parallel transistors of selected aspect ratios each for supplying a corresponding one of said currents by mirroring a reference current in a selected mirroring ratio;

a second plurality of transistors disposed in parallel with said first plurality of transistor and coupled to a source of said reference current for setting said mirroring ratios;

a set of switches for selectively turning-on and turning-off selected ones of said second plurality of transistors to vary said mirroring ratios; and circuitry allowing measurement said reference current in a test mode.

15. The integrated circuit of claim 14 wherein said processing circuitry comprises analog circuitry.

16. The integrated circuit of claim 14 wherein said circuitry for allowing measurement comprises a first switch for selectively decoupling said second plurality of transistors from said source of said reference current and a second switch for selectively coupling said source of said reference current with an external test device.

17. The integrated circuit of claim 14 wherein said circuitry for generating comprises a current mirror.

18. The integrated circuit of claim 14 wherein said processing circuitry comprises a digital to analog converter.

19. The integrated circuit of claim 14 wherein said processing circuitry comprises a digital to analog converter.

20. The integrated circuit of claim 14 and further comprising a set of fuses for setting a state of set of switches for operation in an operating mode.

21. A method of compensating for variation in a reference current in an integrated circuit comprising the steps of:

providing a plurality of parallel transistors having current paths coupled to a reference current source, each having a selected aspect ratio;

coupling the reference current source to an external tester using on-chip switches in a test mode;

measuring the reference current; and in response to said step of measuring, selectively turning-on and turning-off the plurality of parallel transistors to obtain a selected total aspect ratio.

22. The method of claim 21 wherein said step of selectively turning-on and turning-off comprises the substep of:

programming a set of non-volatile storage elements, each storage element controlling a state of a switch selectively turning-on and turning-off a corresponding one the plurality of transistors.

* * * * *